US010100265B2

(12) United States Patent
Hanyuda et al.

(10) Patent No.: US 10,100,265 B2
(45) Date of Patent: Oct. 16, 2018

(54) LUBRICATING OIL COMPOSITION FOR INTERNAL COMBUSTION ENGINES

(71) Applicant: SHELL OIL COMPANY, Houston, TX (US)

(72) Inventors: Kiyoshi Hanyuda, Aikou (JP); Kouji Murakami, Aikou (JP); Izumi Kobayashi, Tokyo (JP); Kouichi Kubo, Aikou (JP)

(73) Assignee: SHELL OIL COMPANY, Houston, TX (US)

( * ) Notice: Subject to any disclaimer, the term of this patent is extended or adjusted under 35 U.S.C. 154(b) by 402 days.

(21) Appl. No.: 14/417,864

(22) PCT Filed: Jul. 29, 2013

(86) PCT No.: PCT/EP2013/065897
§ 371 (c)(1),
(2) Date: Jan. 28, 2015

(87) PCT Pub. No.: WO2014/019981
PCT Pub. Date: Feb. 6, 2014

(65) Prior Publication Data

US 2015/0203779 A1 Jul. 23, 2015

(30) Foreign Application Priority Data

Jul. 30, 2012 (JP) ..... 2012-168935

(51) Int. Cl.
*C10M 129/76* (2006.01)
*C10M 169/04* (2006.01)
*F02B 43/02* (2006.01)

(52) U.S. Cl.
CPC ..... *C10M 129/76* (2013.01); *C10M 169/04* (2013.01); *F02B 43/02* (2013.01); *C10M 2203/1006* (2013.01); *C10M 2203/1025* (2013.01); *C10M 2205/022* (2013.01); *C10M 2205/173* (2013.01); *C10M 2207/289* (2013.01); *C10M 2209/084* (2013.01); *C10M 2229/041* (2013.01); *C10N 2220/022* (2013.01); *C10N 2220/025* (2013.01); *C10N 2230/02* (2013.01); *C10N 2230/06* (2013.01); *C10N 2230/26* (2013.01); *C10N 2230/78* (2013.01); *C10N 2240/10* (2013.01); *C10N 2240/103* (2013.01); *C10N 2240/104* (2013.01)

(58) Field of Classification Search
CPC ..... C10M 2207/282
USPC ..... 508/501
See application file for complete search history.

(56) References Cited

U.S. PATENT DOCUMENTS

| | | | | |
|---|---|---|---|---|
| 2007/0132274 | A1 | 6/2007 | Lam et al. | |
| 2008/0171677 | A1 | 7/2008 | Buck et al. | |
| 2009/0111720 | A1 | 4/2009 | Boffa | |
| 2010/0024287 | A1* | 2/2010 | Smith | C10L 1/00 44/410 |
| 2010/0093578 | A1* | 4/2010 | Tsujimoto | C10M 167/00 508/430 |
| 2011/0067663 | A1 | 3/2011 | Lamb et al. | |

FOREIGN PATENT DOCUMENTS

| | | | |
|---|---|---|---|
| CN | 101407742 | A | 4/2009 |
| JP | 2004155881 | A | 6/2004 |
| JP | 2006241437 | A | 9/2006 |
| WO | 2012071185 | A2 | 5/2012 |

OTHER PUBLICATIONS

DeSilva et al: "Tribometer Investigation of the Frictional Response of Piston Rings when Lubricated with the Separated Phases of Lubricant Contaminated with the Gasoline Engine Biofuel Ethanol and Water"; Tribology Letters; vol. 43, No. 2; pp. 107-120; Jun. 18, 2011.

* cited by examiner

*Primary Examiner* — Vishal Vasisth

(57) ABSTRACT

A lubricating oil composition for internal combustion engines containing a base oil mixture with specific properties and a monoglyceride with a specific structure. The lubricating oil composition of the present 5 invention, as well as providing outstanding wear resistance and fuel economy, causes condensed water etc. from water vapor produced as a result of fuel combustion to be dispersed in the oil, so preventing corrosion or rusting of the engine.

18 Claims, No Drawings

LUBRICATING OIL COMPOSITION FOR INTERNAL COMBUSTION ENGINES

PRIORITY CLAIM

The present application is the National Stage (§ 371) of International Application No. PCT/EP2013/065897, filed Jul. 29, 2013, which claims priority from Japanese Patent Application No. 2012-168935, filed Jul. 30, 2012, the disclosures of which are incorporated herein by reference.

FIELD OF THE INVENTION

The present invention relates to an internal combustion engine lubricating oil composition designed for fuel economy and incorporating a monoglyceride with a hydroxyl value of not less than 150 mgKOH/g (a glycerine fatty acid ester with the fatty acid ester bonded to one of the three hydroxyl groups of glycerine) as a friction modifier so as to realize fuel economy in internal combustion engines (hereinafter these may also be termed 'engines'). This provides a high-performance lubricating oil composition for internal combustion engines that causes condensed water from water vapour produced as a result of combustion of the fuel to be dispersed in the oil, so preventing corrosion or rusting of the engine.

BACKGROUND OF THE INVENTION

In order to reduce the fuel consumption of the engine, modern vehicles have an idle-stop function that cuts in when the vehicle stops at traffic lights and the like, so that the engine stops frequently during town driving. The temperature of the engine lubricating oil therefore does not rise sufficiently during short trips to the shops and so on, and the trip is over before water mixed up in the oil can evaporate and be expelled. With PHV (Plug-in-Hybrid) vehicles and the like too, the engine similarly will have failed to reach a sufficient temperature when the vehicle stops after short commuting or shopping trips due to the on-off switching of engine revolutions as required. Water vapour created by combustion of the fuel therefore enters the sump together with blow-by gas, and because the engine is not hot enough, it condenses in the sump to form water droplets and these become mixed into the engine lubricating oil.

Furthermore, renewable biofuels have increasingly been used in automotive gasoline and light oils in recent years from the standpoint of reducing carbon dioxide emissions to counter global warming.

For example, plans are being pursued under the Japanese Energy Supply and Security Act for year-on-year reductions in greenhouse gases ($CO_2$) by incorporating such renewable biofuels into automotive gasoline. In fact, 210,000 KL/year of biofuel, as the crude oil equivalent, was used in automotive gasoline in 2010, and it is planned that 500,000 KL/year of biofuel, as the crude oil equivalent, should be used by 2017.

These biofuels, specifically bioethanol or bioETBE (ethyl tert-butyl ether), are fuels for internal combustion engines containing high proportions of hydrogen (H/C) even among the hydrocarbons used in fuels, and so generate more water (water vapour) associated with combustion than ordinary fuels. The H/C (hydrogen/carbon) ratio of commercial premium gasoline and regular gasoline is respectively 1.763 and 1.875 calculated from the carbon concentrations shown in Table 2.4-1 of Oil Industry Promotion Center: 2005 Automotive Fuel Research Findings Report PEC-2005JC-16, 2-14. If 3% of such premium gasoline and regular gasoline were to be replaced with (bio)ethanol or similar, their H/C ratios would be respectively about 1.80 and 1.91. H/C thus rises as a result of using biofuel in gasoline, and although there is less carbon dioxide due to combustion, more water vapour is generated. Similarly, looking at the H/C ratios for commercial light oils, 'BASE' corresponding to a commercial light oil 2 in Table 4.1.1-2 of Oil Industry Promotion Center: 2008 Research and Development Findings Report on Diversification and Efficient Use of Automotive Fuels 14 has H/C of 1.91, and JIS2 diesel light oil has H/C of 1.927 according to Table 2 of Traffic Safety Environment Laboratory, Forum 2011 Data, "Adopting the trends and traffic research on advanced automotive fuels in the International Energy Agency (IEA)". If 5% of these were replaced with methyl stearate as a typical biodiesel, H/C would rise to about 1.93 and although less carbon dioxide would be generated by combustion, on the other hand, more water vapour would be produced.

The situation is similar for the engines of vehicles that run on fuels of natural gas, LPG or propane, which have high hydrogen-carbon (H/C) ratios.

The most recent petrol engine oil standards, API-SN+RC (Resource Conserving) and ILSAC GF-5 standards, require that even vehicles using E85 fuels containing bioethanol should have the capacity to ensure that any (condensed) water or E85 fuel is emulsified and incorporated within the engine oil, so that any water from combustion and unburnt ethanol become mixed with the engine oil and water droplets will not precipitate out on metal surfaces to cause rust or corrosion around them (ASTM D7563: Emulsion Retention). Emulsion retention (emulsion stability) is a test with evaluation procedures laid down in ASTM D7563. This is a test to check and evaluate the stability of engine oil in respect of whether any (condensed) water or E85 fuel and the like that has become mixed with it does not deposit out on surfaces but remains incorporated in emulsion form without separating out, so that the individual engine components do not rust or corrode.

Furthermore, in recent years, ashless friction modifiers such as fatty acid esters have come to be added to engine lubricating oils so as to reduce friction between metals in the engine and improve fuel economy (Laid-open Patent JP2004-155881A; Tribologist, Namiki N, Vol. 48, 11 (2003), 903-909).

Organic molybdenum compounds and the like are often used as friction modifiers. However, ashless friction modifiers (i.e. leaving no ash residue when combusted as they contain no elements such as metals or phosphorus) that do not harm exhaust gas treatment equipment such as exhaust gas catalysts or diesel particulate filters (DPF) and do not affect the environment either have been preferred in recent years.

As such ashless friction modifiers added to engine lubricating oils contain neither metals nor elements such as phosphorus, they are known to have little effect on exhaust gas catalysts or exhaust gas post-treatment systems, and to be readily usable in engine lubricating oils. On the downside, they have a surfactant effect and, in some cases, this may intensify anti-emulsifying properties or water separability in the engine oil and cause water to deposit out on surfaces more readily. It has been feared that the deposited water would induce rusting or corrosion by coming into contact with the individual parts in the engine.

In particular, monoglyceride ashless friction modifiers are known to be highly effective for reducing friction and to be suitable for engine lubricating oil compositions, but if condensed water from water vapour associated with fuel combustion in the engine gets into the engine oil as described previously, it has been feared that this would increase anti-emulsifying properties or water separability.

Lubricating oil compositions for internal combustion engines that not only provide outstanding wear resistance and fuel economy (low-friction characteristics) but also cause condensed water from water vapour produced by fuel combustion to be dispersed through the oil to prevent corrosion or rusting of the engine have been being sought for this reason.

The present invention was devised in the light of the above situation and seeks to provide a lubricating oil composition for internal combustion engines that, as well as providing outstanding wear resistance and fuel economy, causes condensed water etc. from water vapour produced as a result of fuel combustion to be dispersed in the oil, so preventing corrosion or rusting of the engine.

On checking the anti-emulsifying properties and water separability of the monoglycerides with a specific structure used as ashless friction modifiers in specific engine lubricating oils {in particular, at least one base oil selected from the group consisting of base oils of Groups 2, 3 and 4 in the API (American Petroleum Institute) base oil categories with kinematic viscosity of from 3 to 12 $mm^2/s$ at 100° C. and viscosity index of not less than 100}, the present inventors established that when condensed water from water vapour associated with fuel combustion in the engine becomes mixed in with the engine oil, monoglycerides with the said specific structure increase anti-emulsifying properties or water separability in connection with the aforesaid specific engine lubricating oils and make separation of the water onto surfaces more prone to occur. They therefore established that using monoglycerides with the said specific structure on their own serves to reduce resistance to rusting or corrosion, and that the aforesaid specific engine lubricating oil compositions containing monoglycerides with the said specific structure do not comply with the most recent petrol engine oil standards API-SN+RC and ILSAC GF-5.

The present inventors further undertook wide-ranging studies and research on ways of improving emulsion stability in the aforesaid specific engine lubricating oils. They discovered that if a base oil mixture comprising at least two base oils in different API (American Petroleum Institute) categories was used together with the aforesaid monoglyceride ashless friction modifiers with a specific structure, and the properties of the aforesaid base oil mixture (sulphur content present in the base oil mixture and % CA in the base oil mixture, etc.) were set to within specific ranges, the lubricating oils showed improved emulsion stability in addition to outstanding wear resistance and fuel economy. They thus perfected the present invention.

SUMMARY OF THE INVENTION

According to the present invention there is provided a lubricating oil composition for internal combustion engines characterised in that it contains:

(A) a base oil mixture comprising at least two base oils in different API (American Petroleum Institute) categories, the base oil mixture having sulphur content of from 0.14 to 0.7 mass %, % CA in accordance with ASTM D3238 of from 0.9 to 5.0, and % CP in accordance with ASTM D3238 of 60 or over, and (B) a monoglyceride with a hydrocarbon group having from 8 to 22 carbon atoms (a glycerine fatty acid ester with the fatty acid ester bonded to one of the three hydroxyl groups of the glycerine), wherein the monoglyceride has a hydroxyl value of from 150 to 300 mgKOH/g, and wherein the monoglyceride is present at a level of from 0.3 to 2.0 mass % based on the total mass of the composition.

It is preferred that the base oil mixture (A) incorporates a base oil classified as Group 1 by the API (American Petroleum Institute) with kinematic viscosity at 100° C. of from 3 to 12 $mm^2/s$, viscosity index of from 90 to 120, sulphur content of from 0.03 to 0.7 mass %, % CA of 5 or less according to ASTM D3238 and % CP of 60 or over according to ASTM D3238, and which is present at a level of from 25 to 50 mass % based on the total mass of the composition.

In a preferred embodiment herein the monoglyceride (B) is glycerine monooleate.

In a preferred embodiment herein the lubricating oil composition of the present invention has a kinematic viscosity at 100° C. in the range of from 5.6 to 15 $mm^2/s$.

Preferably, the lubricating oil composition of the present invention is employed in internal combustion engines using fuels with H/C ratios of from 1.93 to 4, internal combustion engines of vehicles fitted with idle-stop equipment, or internal combustion engines using fuels incorporating biofuels or biodiesel.

By following this invention, lubricating oil compositions for internal combustion engines are obtained that, as well as providing outstanding wear resistance and fuel economy, also have the capacity to disperse condensed water due to water vapour produced as a result of combustion of the fuel as a stable emulsion through the oil and so prevent corrosion or rusting of the engine.

DETAILED DESCRIPTION OF THE INVENTION

The present invention relates to a lubricating oil composition for internal combustion engines characterised in that it contains:

(A) a base oil mixture comprising at least two base oils in different API (American Petroleum Institute) categories, the base oil mixture having sulphur content of from 0.14 to 0.7 mass %, % CA in accordance with ASTM D3238 of from 0.9 to 5.0, and % CP in accordance with ASTM D3238 of 60 or over, and (B) a monoglyceride with a hydrocarbon group having from 8 to 22 carbons (a glycerine fatty acid ester with the fatty acid ester bonded to one of the three hydroxyl groups of the glycerine), wherein the monoglyceride has a hydroxyl value of from 150 to 300 mgKOH/g, and wherein the monoglyceride is present at a level of from 0.3 to 2.0 mass % based on the total mass of the composition.

Base Oil Mixture

Mineral oils and hydrocarbon synthetic oils known as highly refined base oils can be used in base oil mixtures for these lubricating oil compositions. In particular, base oils belonging to Group 1, Group 2, Group 3 and Group 4 in the base oil categories defined by the API (American Petroleum Institute) may be used as mixtures of at least two types. The base oil mixture used herein should have a kinematic viscosity at 100° C. of from 3 to 12 $mm^2/s$, preferably from 3 to 10 $mm^2/s$ and more preferably from 3 to 8 $mm^2/s$. Its viscosity index should be in the range of from 100 to 180, preferably in the range of from 100 to 160 and more preferably in the range of from 100 to 150. Its sulphur content should be in the range of from 0.14 to 0.7 mass %, preferably in the range of from 0.15 0.5 mass %, more preferably in the range of from 0.16 to 0.3 mass %, and most preferably from 0.16 to 0.23 mass %. Moreover, % CA in accordance with ASTM D3238 should be in the range of from 0.9 to 5.0, preferably in the range of from 0.9 to 3.5 and more preferably in the range of from 1.0 to 1.6. Also, % CP in accordance with ASTM D3238 should be not less than 60, preferably not less than 65 and more preferably not less than 72. Further, its density at 15° C. should be in the range of from 0.8 to 0.9 g/cm$^3$, preferably in the range of from 0.8 to 0.865 g/cm$^3$ and more preferably in the range of from 0.81 to 0.83 g/cm$^3$.

Examples of Group 1 base oils include paraffin-series mineral oils obtained by applying appropriate combinations of refining steps such as solvent refining, hydrorefining and dewaxing to lubricating oil fractions obtained by normal-pressure distillation of crude oil. The Group 1 base oils used herein should have kinematic viscosity at 100° C. of from 3 to 12 mm$^2$/s, preferably from 3 to 10 mm$^2$/s and more preferably from 3 to 8 mm$^2$/s. Their viscosity index should be in the range of from 90 to 120, preferably in the range of from 95 to 110 and more preferably in the range of from 95 to 100. Their sulphur content should be in the range of from 0.03 to 0.7 mass %, preferably in the range of from 0.3 to 0.7 mass % and more preferably in the range of from 0.48 to 0.67 mass %. Moreover, % CA in accordance with ASTM D3238 should be not more than 5, preferably not more than 4 and more preferably not more than 3.4. Further, % CP in accordance with ASTM D3238 should be not less than 60, preferably not less than 63 and more preferably not less than 66.

Base oils with kinematic viscosity of less than 3 mm$^2$/s are undesirable as they have high NOACK volatility (ASTM D5800) and are subject to greater evaporation losses. Kinematic viscosity exceeding 12 mm$^2$/s is undesirable as this leads to higher low-temperature viscosity (ASTM D5293, ASTM D4684) in the final product when used. Moreover, % CA greater than 5 and % CP less than 60 are undesirable because, although the solubility and polarity of the base oil improve, its heat and oxidation stability fall. Further, if the sulphur content is greater than 0.7 mass %, at the same time as giving lower heat and oxidation stability in the final engine oil product, this is undesirable for exhaust gas post-treatment apparatus such as DeNOx catalysts or DPF (Diesel Particulate Filters) and the like.

There are no particular restrictions on the composition of base oil mixtures for the present invention, but base oil mixtures incorporating a base oil classed as API (American Petroleum Institute) Group 1 with kinematic viscosity at 100° C. of from 3 to 12 mm$^2$/s, viscosity index of from 95 to 120, sulphur content from 0.03 to 0.7 mass %, % CA in accordance with ASTM D3238 not more than 5 and % CP in accordance with ASTM D3238 not less than 60, and present at a level of from 25 to 50 mass %, preferably at a level of from 25 to 50 mass % and more preferably at a level of from 25 to 40 mass % based on the total mass of the composition, are ideal for this use. It is desirable to keep the Group 1 base oil applied to the final product to within 50 mass % in order to maintain heat and oxidation stability. It is desirable for the sulphur content in the engine oil product overall to be not more than 0.6 mass % in the case of 10W-X (X denotes SAE viscosity on the high-temperature side, such as 20, 30, 40), or not more than 0.5 mass % for engine oils such as 0W-X, 5W-X with good low-temperature viscosity, as this has no effect on exhaust gas treatment equipment and the like.

Examples of Group 2 base oils include, for example, paraffin-series mineral oils obtained by applying appropriate combinations of refining steps such as hydrocracking and dewaxing to lubricating oil fractions obtained by normal-pressure distillation of crude oil. Group 2 base oils refined by the hydrorefining process of Gulf Oil and so on have total sulphur contents of less than 10 ppm and aromatic contents of not more than 5% and are ideal for the present invention. There are no particular restrictions on the viscosity of these base oils, but their viscosity index is preferably in the range of from 100 to 120 (viscosity index in the present invention is determined in accordance with ASTM D2270 and JIS K2283). Kinematic viscosity at 100° C. (kinematic viscosity in the present invention is measured in accordance with ASTM D445 and JIS K2283) should preferably be in the range of from 3 to 12 mm$^2$/s and more preferably in the range of from 3 to 9 mm$^2$/s. Their total sulphur content should be less than 300 ppm, preferably less than 200 ppm and still more preferably less than 10 ppm. Their total nitrogen content should also be less than 10 ppm and preferably less than 1 ppm. Those with aniline points (aniline point in the present invention is determined by ASTM D611 and JIS K2256) at 80 to 150° C. and preferably from 100 to 135° C. should be used.

For example, paraffin-series mineral oils produced by high-level hydrorefining of lubricating oil fractions obtained by normal-pressure distillation of crude oil, base oils refined by the ISODEWAX process, which converts to isoparaffin and dewaxes the waxes formed in dewaxing processes, and base oils refined by the Mobil Wax Isomerization process are also ideal. These base oils correspond to API Group 2 and Group 3. There are no particular restrictions on their viscosity but their viscosity index should be in the range of from 100 to 150 and preferably in the range of from 100 to 145. Their kinematic viscosity at 100° C. should preferably be in the range of from 3 to 12 mm$^2$/s and more preferably in the range of from 3 to 9 mm$^2$/s. Moreover, their sulphur content should be from 0 to 100 ppm and preferably less than 10 ppm. Their total nitrogen content should also be less than 10 ppm and preferably less than 1 ppm. Furthermore, those with aniline points at 80 to 150° C. and preferably 110 to 135° C. should be used.

GTL (gas to liquid) oils synthesized by the Fischer-Tropsch process, a liquid fuel conversion technique for natural gas, are even better as base oils for this invention than mineral base oils refined from crude oil because they have very much lower sulphur contents or aromatic contents and very much higher paraffin component ratios and so provide outstanding oxidation stability and very low evaporation losses. There are no particular restrictions on the viscosity properties of GTL base oils, but their usual viscosity index should be in the range of from 100 to 180 and more preferably in the range of from 100 to 150. Their kinematic viscosity at 100° C. should be in the range from 3 to 12 mm$^2$/s and more preferably in the range from 3 to 9 mm$^2$/s.

Their usual total sulphur content should be less than 10 ppm and total nitrogen content less than 1 ppm. SHELL XHVI (registered trade mark) may be cited as an example of such GTL base oil products.

Examples of hydrocarbon synthetic oils include polyolefins, alkylbenzenes and alkylnaphthalenes, or mixtures of these.

The above polyolefins include polymers of all types of olefin or hydrides of these. Any desired olefin may be used, but examples include ethylene, propylene, butene and α-olefins with five or more carbons. To prepare polyolefins, one type of the above olefins may be used on its own or two or more types may be combined.

In particular, the polyolefins known as polyalphaolefins (PAO) are ideal. These are Group 4 base oils. Polyalphaolefins may also be mixtures of two or more synthetic oils.

There are no particular restrictions on the viscosity of these synthetic oils, but their kinematic viscosity at 100° C. should be in the range of from 3 to 12 $mm^2/s$, preferably in the range of from 3 to 10 $mm^2/s$ and more preferably in the range of from 3 to 8 $mm^2/s$. The viscosity index of these synthetic base oils should be in the range of from 100 to 170, preferably in the range of from 110 to 170 and more preferably the range of from 110 to 155. The density of these synthetic base oils at 15° C. should be in the range of from 0.8000 to 0.8600 $g/cm^3$, preferably in the range of from 0.8100 to 0.8550 $g/cm^3$, and more preferably in the range of from 0.8250 to 0.8500 $g/cm^3$.

There are no particular restrictions on the content of the above base oils in lubricating oil compositions of the present invention, but ranges of from 50 to 90 mass %, preferably from 50 to 80 mass %, and more preferably from 50 to 70 mass % based on the total mass of the lubricating oil composition may be cited.

Monoglycerides

The hydrocarbon group moiety of the fatty acid in the monoglycerides used as ashless friction modifiers has from 8 to 22 carbon atoms. Specific examples of such $C_8$-$C_{22}$ hydrocarbon groups include alkyl groups such as the octyl group, nonyl group, decyl group, undecyl group, dodecyl group, tridecyl group, tetradecyl group, pentadecyl group, hexadecyl group, heptadecyl group, octadecyl group, nonadecyl group, icosyl group, henicosyl group or docosyl group (these alkyl groups may be straight-chain or branched), and alkenyl groups such as the octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, icosenyl group, henicosenyl group or docosenyl group (these alkenyl groups may be straight-chain or branched, and the double bond position may optionally be of the cis or trans form).

It is ideal for the hydroxyl value to be in the range from 150 to 300 mgKOH/g and more preferably in the range from 200 to 300 mgKOH/g based on the technique for determining hydroxyl values set out in JIS K0070. Monoglyceride contents ranging from 0.3 to 2.0 mass %, preferably from 0.4 to 1.7 mass % and more preferably from 0.5 to 1.5 mass % based on the total mass of the composition may be cited. Ratios for "monoglyceride mass % in the lubricating oil composition/% CA in the base oil" ranging from 0.1 to 1.0, preferably from 0.3 to 1.0 and more preferably from 0.5 to 0.9 may be cited. Moreover, ratios for "monoglyceride mass % in the lubricating oil composition/sulphur mass % in the base oil" ranging from 1.0 to 6.5, preferably from 3.5 to 6.0 and more preferably from 3.9 to 5.7 may also be cited.

Other Optional Ingredients

Various additives besides the ingredients stated above may be used if necessary and as appropriate in order further to enhance performance. Examples of these include antioxidants, metal deactivators, anti-wear agents, antifoaming agents, viscosity index improvers, pour point reducers, cleansing dispersants, rust inhibitors and so on, and any other known additives for lubricating oils.

Those antioxidants used in lubricating oils are desirable in practical terms as antioxidants to be used in the present invention, and examples include amine-series antioxidants, sulphur-series antioxidants, phenol-series antioxidants and phosphorus-series antioxidants. These antioxidants may be used individually or as combinations of several types in the range from 0.01 to 5 parts by weight relative to 100 parts by weight of base oil.

Examples of the above amine antioxidants include dialkyl-diphenylamines such as p,p'-dioctyl-diphenylamine (Seiko Chemical Co. Ltd: Nonflex OD-3), p,p'-di-α-methylbenzyl-diphenylamine or N-p-butylphenyl-N-p'-octylphenylamine;

monoalkyldiphenylamines such as mono-t-butyldiphenylamine or monooctyldiphenylamine;

bis(dialkylphenyl)amines such as di(2,4-diethylphenyl) amine or di(2-ethyl-4-nonylphenyl)amine; alkylphenyl-1-naphthylamines such as octylphenyl-1-naphthylamine or N-t-dodecylphenyl-1-naphthylamine; allyl-naphthylamines such as 1-naphthylamine, phenyl-1-naphthylamine, phenyl-2-naphthylamine, N-hexylphenyl-2-naphthylamine or N-octylphenyl-2-naphthylamine; phenylenediamines such as N,N'-diisopropyl-p-phenylenediamine or N,N'-diphenyl-p-phenylenediamine; and phenothiazines such as phenothiazine (Hodogaya Chemical Co. Ltd: phenothiazine) or 3,7-dioctylphenothiazine, and so on.

Examples of sulphur-series antioxidants include dialkylsulfides such as didodecylsulfide or dioctadecylsulfide;

thiodipropionate esters such as idodecylthiodipropionate, dioctadecylthiodipropionate, dimyristilthiodipropionate or dodecyloctadecylthiodipropionate; and 2-mercaptobenzoimidazole, and so on.

Examples of phenol antioxidants include 2,6-di-t-butyl-4-alkylphenols such as 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (Kawaguchi Chemical Industry Co. Ltd: Antage DBH), 2,6-di-t-butylphenol, 2,6-di-t-butyl-4-methylphenol or 2,6-di-t-butyl-4-ethylphenol; and 2,6-di-t-butyl-4-alkoxyphenols such as 2,6-di-t-butyl-4-methoxyphenol or 2,6-di-t-butyl-4-ethoxyphenol.

There are also alkyl-3-(3,5-di-t-butyl-4-hydroxyphenyl) propionates such as 3,5-di-t-butyl-4-hydroxybenzylmercapto-octylacetate, n-octadecyl-3-(3,5-di-t-butyl-4-hydroxyphenyl)propionate (Yoshitomi Yakuhin Corporation: Yoshinox SS), n-dodecyl-3-(3,5-di-t-butyl-4-hydroxyphenyl)propionate, 2'-ethylhexyl-3-(3,5-di-t-butyl-4-hydroxyphenyl)propionate or benzenepropanate 3,5-bis(1,1-dimethyl-ethyl)-4-hydroxy-C7-C9 side chain alkylester (Ciba Specialty Chemical Co.: Irganox L135); and 2,2'-methylene bis(4-alkyl-6-t-butylphenol)s such as 2,6-di-t-butyl-α-dimethylamino-p-cresol, 2,2'-methylene bis(4-methyl-6-t-butylphenol) (Kawaguchi Chemical Industry Co. Ltd: Antage W-400) or 2,2'-methylene bis(4-ethyl-6-t-butylphenol) (Kawaguchi Chemical Industry Co. Ltd: Antage W-500).

Furthermore, there are bisphenols such as 4,4'-butylidenebis(3-methyl-6-t-butylphenol) (Kawaguchi Chemical Industry Co. Ltd: Antage W-300), 4,4'-methylene bis(2,6-di-t-butylphenol) (Shell Japan: Ionox 220AH), 4,4'-bis(2,6-di-t-butylphenol), 2,2-(di-p-hydroxyphenyl)propane (Shell Japan: bisphenol A), 2,2-bis(3,5-di-t-butyl-4-hydroxyphenyl)propane, 4,4'-cyclohexylidene bis(2,6-t-butylphenol), hexamethyleneglycol bis[3-(3,5-di-t-butyl-4-hydroxyphenyl)propionate] (Ciba Specialty Chemical Co.: Irganox L109), triethyleneglycol bis[3-(3-t-butyl-4-hydroxy-5-methylphenyl)propionate] (Yoshitomiyakuhin Corporation: Tominox 917), 2,2'-thio-[diethyl-3-(3,5-di-t-butyl-4-hydroxyphenyl)propionate] (Ciba Specialty Chemical Co.: Irganox L115), 3,9-bis{1,1-dimethyl-2-[3-(3-t-butyl-4-hydroxy-5-methylphenyl)propionyloxy]ethyl}2,4,8,10-tetraoxaspiro[5,5]undecane (Sumitomo Chemicals: Sumilyzer GA80), 4,4'-thiobis(3-methyl-6-t-butylphenol) (Kawaguchi Chemical Industry Co. Ltd: Antage RC) or 2,2'-thiobis(4,6-di-t-butyl-resorcin).

Then there may also be cited polyphenols such as tetrakis [methylene-3-(3,5-di-t-butyl-4-hydroxyphenyl)propionate] methane (Ciba Specialty Chemical Co.: Irganox L101), 1,1,3-tris(2-methyl-4-hydroxy-5-t-butylphenyl) butane (Yoshitomiyakuhin Corporation: Yoshinox 930), 1,3,5-trimethyl-2,4,6-tris(3,5-di-t-butyl-4-hydroxybenzyl)benzene (Shell Japan: Ionox 330), bis-[3,3'-bis-(4'-hydroxy-3'-t-butylphenyl)butyric acid]glycol ester, 2-(3',5'-di-t-butyl-4-hydroxyphenyl)methyl-4-(2",4"-di-t-butyl-3"-hydroxyphenyl) methyl-6-t-butylphenol, 2,6-bis(2'-hydroxy-3'-t-butyl-5'-methyl-benzyl)-4-methylphenol; and phenolaldehyde condensates such as condensates of p-t-butylphenol with formaldehyde, or condensates of pt-butylphenol with acetaldehyde.

Examples of phosphorus-series antioxidants include triallyl phosphites such as triphenyl phosphite or tricresyl phosphite; trialkyl phosphites such as trioctadecyl phosphite or tridecyl phosphite; and tridodecyltrithio phosphite.

The amounts of sulphur- and phosphorus-series antioxidants incorporated need to be restricted in consideration of their effects on the exhaust gas control systems of internal combustion engines. It is preferable for the content of phosphorus in the lubricating oil overall not to exceed 0.10 mass % and of sulphur not to exceed 0.6 mass %, and more preferable for the phosphorus content not to exceed 0.08 mass % and the sulphur content not to exceed 0.5 mass %.

Examples of metal deactivators that can be used concurrently in compositions in this embodiment include benzotriazole and benzotriazole derivatives such as 4-alkyl-benzotriazoles such as 4-methyl-benzotriazole or 4-ethyl-benzotriazole;

5-alkyl-benzotriazoles such as 5-methyl-benzotriazole or 5-ethyl-benzotriazole;

1-alkyl-benzotriazoles such as 1-dioctylaminomethyl-2,3-benzotriazole; or 1-alkyl-tolutriazoles such as 1-dioctylaminomethyl-2,3-tolutriazole; and benzoimidazole and benzoimidazole derivatives such as 2-(alkyldithio)-benzoimidazoles such as 2-(octyldithio)-benzoimidazole, 2-(decyldithio)-benzoimidazole or 2-(dodecyldithio)-benzoimidazole; and 2-(alkyldithio)-toluimidazoles such as 2-(octyldithio)-toluimidazole, 2-(decyldithio)-toluimidazole or 2-(dodecyldithio)-toluimidazole.

There are, moreover, indazole and indazole derivatives such as toluindazoles such as 4-alkyl-indazole or 5-alkyl-indazole; and benzothiazole and benzothiazole derivatives such as 2-(alkyldithio)benzothiazoles such as 2-mercapto-benzothiazole derivative (Chiyoda Kagaku Co. Ltd: Thiolite B-3100) or 2-(hexyldithio)benzothiazole, 2-(octyldithio) benzothiazole;

2-(alkyldithio)toluthiazoles such as 2-(hexyldithio)toluthiazole or 2-(octyldithio)toluthiazole; 2-(N,N-dialkyldithiocarbamyl)benzothiazoles such as 2-(N,N-diethyldithiocarbamyl)benzothiazole, 2-(N,N-dibutyldithiocarbamyl)-benzothiazole or 2-(N,N-dihexyldithiocarbamyl)-benzothiazole; and 2-(N,N-dialkyldithiocarbamyl)-toludithiazoles such as 2-(N,N-diethyldithiocarbamyl) toluthiazole, 2-(N,N-dibutyldithiocarbamyl)toluthiazole or 2-(N,N-dihexyldithiocarbamyl)toluthiazole.

There may also be cited benzoxazole derivatives such as 2-(alkyldithio)-benzoxazoles such as 2-(octyldithio)benzoxazole, 2-(decyldithio)benzoxazole and 2-(dodecyldithio) benzoxazole; and 2-(alkyldithio)toluoxazoles such as 2-(octyldithio)toluoxazole, 2-(decyldithio)toluoxazole and 2-(dodecyldithio)toluoxazole;

thiadiazole derivatives such as 2,5-bis(alkyldithio)-1,3,4-thiadiazoles such as 2,5-bis(heptyldithio)-1,3,4-thiadiazole, 2,5-bis(nonyldithio)-1,3,4-thiadiazole, 2,5-bis(dodecyldithio)-1,3,4-thiadiazole or 2,5-bis(octadecyldithio)-1,3,4-thiadiazole; 2,5-bis(N,N-dialkyldithiocarbamyl)-1,3,4-thiadiazoles such as 2,5-bis(N,N-diethyldithiocarbamyl)-1,3,4-thiadiazole, 2,5-bis(N,N-dibutyldithiocarbamyl)-1,3,4-thiadiazole, and 2,5-bis(N,N-dioctyldithiocarbamyl)-1,3,4-thiadiazole; 2-N,N-dialkyldithiocarbamyl-5-mercapto-1,3,4-thiadiazoles such as 2-N,N-dibutyldithiocarbamyl-5-mercapto-1,3,4-thiadiazole, 2-N,N-dioctyldithiocarbamyl-5-mercapto-1,3,4-thiadiazole; and triazole derivatives such as 1-alkyl-2,4-triazoles such as 1-di-octylaminomethyl-2,4-triazole.

These metal deactivators may be used individually or as mixtures of multiple types in the range from 0.01 to 0.5 parts by weight relative to 100 parts by weight of base oil.

Phosphorus compounds may also be added to lubricating oil compositions in this embodiment in order to impart wear resistance. Zinc dithiophosphates and zinc phosphate may be cited as phosphorus compounds suitable for the present invention. These phosphorus compounds may be used individually or as combinations of multiple types in the range from 0.01 to 2 mass % relative to 100 parts by mass of base oil, with a phosphorus content based on the lubricating oil overall preferably in the range from 0.05 to 0.10 mass % and, more preferably from 0.05 to 0.08 mass %. Phosphorus contents exceeding 0.10 mass % of the lubricating oil overall adversely affect catalysts and the like in exhaust gas control systems, but wear resistance as an engine oil cannot be maintained at phosphorus contents below 0.05%.

Zinc dialkyl dithiophosphates, zinc diallyl dithiophosphates, zinc allylalkyl dithiophosphates and so on may be cited as the above zinc dithiophosphates. As hydrocarbon groups, examples of alkyl groups include primary or secondary alkyl groups with 3 to 12 carbon atoms, and allyl groups may be the phenyl group or an alkylallyl group with the phenyl substituted by an alkyl group having from 1 to 18 carbon atoms.

Zinc dialkyl dithiophosphates with secondary alkyl groups are to be preferred among these zinc dithiophosphates, and these have from 3 to 12 carbon atoms, preferably from 3 to 8 carbon atoms and more preferably from 3 to 6 carbon atoms.

Pour point reducers or viscosity index improvers may be added to lubricating oil compositions in the present invention in order to improve their low-temperature pouring properties or viscosity characteristics. Viscosity index improvers include, for example, polymethacrylates or olefin polymers such as ethylene-propylene copolymers, styrene-diene copolymers, polyisobutylene, polystyrene, and the like. The amount added may be in the range of from 0.05 to 20 parts by weight relative to 100 parts by weight of base oil.

Polymers of the polymethacrylate series may be cited as examples of pour point reducers. The amount added may be in the range of from 0.01 to 5 parts by weight relative to 100 parts by weight of base oil.

Antifoaming agents may also be added to lubricating oil compositions of the present invention in order to impart antifoaming properties. Examples of antifoaming agents suitable for this embodiment include organosilicates such as dimethyl polysiloxane, diethyl silicate and fluorosilicone, and non-silicone antifoaming agents such as polyalkylacrylates. The amount added may be in the range from 0.0001 to 0.1 parts by weight relative to 100 parts by weight of base oil.

There are no particular restrictions on the viscosity of lubricating oil compositions in this embodiment, but the kinematic viscosity at 100° C. should be in the range of from 5.6 to 15 $mm^2/s$, preferably from 5.6 to 12.5 $mm^2/s$ and more preferably from 8.4 to 10.8 $mm^2/s$.

Lubricating oil compositions of the present invention are used as lubricating oil compositions for internal combustion engines. Lubricating oil compositions of the present invention can be used in internal combustion engines burning fuels with H/C ratios of from 1.93 to 4 (preferably from 2.67 to 4). Examples of such fuels with H/C ratios of from 1.93 to 4 include fuels in which 5% of JIS2 diesel light oil has been replaced with methyl stearate as a typical biodiesel fuel (H/C=1.93), propane (H/C=2.6) and natural gas (H/C=4 with methane as the main constituent). Lubricating oil compositions of the present invention may also be used in the internal combustion engines of vehicles fitted with idle-stop apparatus. Furthermore, lubricating oil compositions of the present invention are ideal for use in internal combustion engines using biofuels (e.g. bioethanol, ethyl tert-butylether, or cellulose-series ethanol) or biodiesel fuels (e.g. fuels incorporating hydroprocessed oils cracked and refined applying the hydroprocessing techniques for petroleum refining to fatty acid methylesters and raw oils and fats from plants or tallow, or synthetic oils prepared by synthesizing liquid hydrocarbons using catalyst reactions from carbon monoxide and hydrogen generated by applying the FT (Fischer-Tropsch) process to biomass thermal decomposition gas). In particular, the lubricating oil compositions of the present invention are ideal for use in internal combustion engines using fuels incorporating more than 3 vol %, preferably 5 vol % or over and more preferably 10 vol % or over of bioethanol in the fuel. In particular, the lubricating oil compositions of the present invention are ideal for use in internal combustion engines using fuels incorporating more than 5 mass %, preferably 7 mass % or more and more preferably 10 mass % or more of biodiesel in the fuel.

Examples

Examples and Comparative Examples are used below to describe in specific terms the lubricating oil compositions of the present invention for internal combustion engines that, as well as providing outstanding wear resistance and fuel economy, also cause condensed water from water vapour produced by fuel combustion to be dispersed through the oil and prevent corrosion or rusting of the engine. However, the present invention is not restricted in any way by these.

Constituents

The following constituents were prepared for the formulations in the Examples and Comparative Examples.

(1) Base Oils

Base oils 1 to 7 used in the Examples and Comparative Examples had the properties set out in Table 1. The values given herein for kinematic viscosity at 40° C. and 100° C. had been determined in accordance with JIS K 2283 "Crude Oil and Petroleum Products—Kinematic Viscosity Test Method and Determination of Viscosity Index". The values cited for viscosity index had also been obtained in accordance with JIS K 2283 "Crude Oil and Petroleum Products—Kinematic Viscosity Test Method and Determination of Viscosity Index". Pour point (PP) was determined in accordance with JIS K 2269, flash point with JIS K 2265-4 (COC: Cleveland Open Cup technique), and sulphur content with JIS K 2541 (radioexcitation technique). ASTM D3238 was used as regards % $C_A$, % $C_N$ and % Cp.

(2) Additives (2-1) Additive A1: Glycerine monooleate (commercially available from Kao Corporation under the tradename Excel O-95R)

Molecularly Distilled Monoglyceride

Melting point 40° C.

Hydroxyl value 220 mgKOH/g (2-2) Additive B: GF-5 package (an Additive Package For Internal Combustion Engine Oils).

The product catalogue from Oronite Co. states that adding 8.9-10.55 mass % of this additive to lubricating oil provides performance meeting the API-SN and ILSAC GF-5 standards. In these examples, the content of Additive B was set at 9.05 mass % meeting the ILSAC GF-5 standards, but there is no particular restriction on the content of Additive B.

(2-8) Additive C1: Viscosity index improver −1 Polymethacrylate series viscosity index improver. Non-dispersion type.

Formula (1):

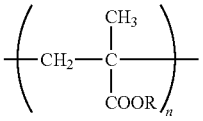

(1)

(2-9) Additive C2: Viscosity index improver −2 Olefin copolymer viscosity index improver. Non dispersing type.

Formula 2:

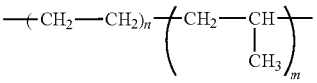

(2)

(2-10) Additive D: Antifoaming agent solution Antifoaming agent solution comprising 3 mass % of a dimethyl polysiloxane type of silicone oil dissolved in light oil.

Preparation of Lubricating Oil Compositions

Lubricating oil compositions were prepared in Examples 1 to 4 and Comparative Examples 1 to 6 using the above constituents to have the formulations shown in Table 2.

Tests

The lubricating oil compositions prepared in Examples 1 to 4 and Comparative Examples 1 to 6 underwent the various tests shown below in order to assess their performance. The results of these tests are shown in Table 2 below.

(1) Kinematic Viscosity at 100° C.

Kinematic viscosity at 100° C. was determined in accordance with JIS K 2283 "Crude Oil and Petroleum Products—Kinematic Viscosity Test Method and Determination of Viscosity Index".

(2) Low-Temperature Viscosity

Low-temperature viscosity at −30° C. and −35° C. was determined in accordance with ASTM D5293.

(3) Shell Four-Ball Wear Testing

Shell four-ball testing was carried out in accordance with ASTM D4172 under conditions of 1800 rpm, oil temperature 50° C. and load 40 kgf for periods of 30 minutes. After testing, the test balls were removed, the wear scars were measured and the diameter shown as the result.

(4) Friction Coefficient Test

The friction coefficient was determined and evaluated using the Cameron-Plint TE77 tester employed in ASTM- G-133 (American Society for Testing and Materials) in order to observe the friction characteristics. The upper test piece was an SK-3 steel cylinder 6 mm in diameter and 16 mm long, and the lower test piece an SK-3 steel plate. Tests were conducted for ten minutes at a test temperature of 80° C., load 300 N, amplitude 15 mm and frequency 10 Hz, and the mean friction coefficient measured in the final minute when it had stabilized was recorded. The smaller the friction coefficient, the better the friction reduction properties were.

(5) Emulsification Test

The following oil emulsification tests were carried out in accordance with ASTM D7563 in order to evaluate the emulsion stability of the lubricating oils (water-retaining performance).

Evaluation tests were carried out taking simulated E85 fuel and distilled water and using a commercial high-speed blender, for example, a Waring Blender 7011H (currently 7011S) with a stainless steel container from MFI K.K. in this series of tests. The test procedures were as follows.

At room temperature (20° C.±5° C.), 185 mL of the test oil to be evaluated was measured out into a 200 mL measuring cylinder and poured into the 7011H blender. Then 15 mL of simulated E85 fuel was measured out into a 100 mL measuring cylinder and poured into the 7011H blender, and finally 15 mL of distilled water was measured out into a 100 mL measuring cylinder and poured into the 7011H. The cover was put on the container immediately afterwards and the materials were blended at 15000 rpm for 60 seconds. After being blended, 100 mL of the fluid mixture was immediately placed in a 100 mL measuring cylinder with a ground glass stopper making the cover and this was left to stand for 24 hours in a constant-temperature tank at the designated temperature (−5 to 0° C., or 20-25° C.). Having been left to stand in the constant-temperature tank for 24 hours after being blended, the quantities of oil-emulsion-water were read off from the calibrations on the measuring cylinder. Samples showing water separation are shown as 'Separation' and those not showing water separation as 'No separation' or 'No sepn' in Table 2.

The simulated E85 fuel used was prepared by measuring out 150 mL of commercial JIS1 automotive gasoline and 850 mL of special-grade ethanol from Wako Pure Chemical Industries into a measuring cylinder and mixing them at ambient temperature.

If necessary, the tests were completed in times shorter than the designated time and the samples were held in a cool, dark place indoors in containers that could be tightly sealed so as to prevent volatilization of light compounds during use.

ASTM D7563 tests for Comparative Example 5 and Example 4 were carried out by the South West Research Institute, an independent research organization in the USA, and the same results were obtained.

DISCUSSION

Comparative Example 1 was an engine oil containing no glycerine monooleate and showed no water separation in the emulsification tests. However, because it contained no glycerine monooleate, it had a high friction coefficient of 0.112 in the friction coefficient test, and provided no advantage in terms of fuel economy associated with reduced engine friction.

Comparative Examples 2 and 3 were 0W-20 grade engine oils with different viscosity improvers. Friction coefficients not exceeding 0.1 were achieved on adding glycerine monooleate to each of these, and advantages in terms of fuel economy associated with reduced friction coefficients were obtained. Moreover, Comparative Example 4 was a 5W-30 grade engine oil to which glycerine monooleate had been added. A friction coefficient of not more than 0.1 was achieved in this comparative example too, and an advantage in terms of fuel economy associated with reduced friction coefficient was obtained. On the other hand, however, it was evident that the water and oil separated out relatively quickly due to potent surface chemical activity in these types of oil containing glycerine monooleate.

The results for Comparative Examples 2, 3 and 4 demonstrated no differences in emulsifying performance attributable to differences in the type (poly(methacrylate), olefin copolymer), polymer concentration or viscosity of the non-dispersion type of viscosity index improver used.

Lubricating base oils incorporating 10 mass % and 20 mass % of the Group 1 base oil were used in Comparative Examples 5 and 6, but the potent water separability due to the glycerine monooleate could not be overcome.

In Examples 1 to 3 taking lubricating oil base oils incorporating 25 mass % or over of Group 1 base oil, water separability due to the potent surfactant effect of the glycerine monooleate could be overcome and emulsion-retention (emulsion stability) improved. It was also clear that the wear resistance and reduced friction coefficient could be maintained.

In Example 4, a GTL (gas to liquid) base oil synthesized by the Fischer-Tropsch process was chosen even from among API group 3 base oils showing defined properties. It was clear that if 25 mass % of the defined Group 1 oil was incorporated, good wear resistance and friction reduction could be maintained while overcoming water separability and maintaining emulsion-retention (emulsion stability) even with base oils synthesized by the Fischer-Tropsch process.

The above demonstrated that by using a base oil mixture comprising at least two base oils in different API (American Petroleum Institute) categories together with a monoglyceride ashless friction modifier with a specific structure, and setting the properties of said base oil mixture (sulphur content present in the base oil mixture and % CA in the base oil mixture, etc.) to within specific ranges, this serves to improve emulsion stability in addition to providing outstanding wear resistance and fuel economy. Moreover, on calculating the ratio of "monoglyceride mass % in the lubricating oil composition/% CA in the base oil mixture" in Examples 1 to 4 and Comparative Examples 5 and 6, which incorporated a Group 1 base oil, values of 0.5625-0.9 were found for Examples 1 to 4, and of 1.125-2.25 for Comparative Examples 5 and 6. Further, on calculating the ratio of "monoglyceride mass % in the lubricating oil composition/sulphur mass % in the base oil mixture" in Examples 1 to 4 and Comparative Examples 5 and 6, which incorporated a Group 1 base oil, values of 3.91-5.625 were found for Examples 1 to 4, and of 6.923-12.857 for Comparative Examples 5 and 6.

TABLE 1

In Table 1, KV100 and KV40 are the kinematic viscosity at 100° C. and 40° C., respectively

| | | Base oil 1 | Base oil 2 | Base oil 3 | Base oil 4 | Base oil 5 | Base oil 6 | Base oil 7 |
|---|---|---|---|---|---|---|---|---|
| Base oil group (API class) | | Group 3 | Group 3 | Group 2 | Group 1 | Group 1 | Group 1 | Group 3 |
| KV100 | $mm^2$/sec | 4.2 | 7.6 | 3.1 | 4.6 | 7.6 | 11.3 | 5.0 |
| KV40 | $mm^2$/sec | 19.4 | 45.6 | 12.4 | 24.4 | 55.1 | 101.6 | 23.7 |
| Viscosity index | | 123 | 133 | 104 | 99 | 99 | 97 | 146 |
| Pour point | ° C. | −15.0 | −12.5 | −32.5 | −20.0 | −12.5 | −10.0 | −20.0 |
| Flash point | ° C. | 214 | 240 | 194 | 228 | 256 | 262 | 232 |
| Sulphur content | mass % | 0.0008 | 0.001 | <0.01 | 0.48 | 0.62 | 0.67 | <0.01 |
| ASTM D3238-95 | % $C_A$ | 0 | 0 | 0 | 3.4 | 3.2 | 2.9 | 0 |
| | % $C_N$ | 22.4 | 20.4 | 31.1 | 30.1 | 30.7 | 29.7 | 7 |
| | % $C_P$ | 77.6 | 79.6 | 69.9 | 66.5 | 66.1 | 67.4 | 93 |

TABLE 2

| | | | Comp Ex 1 | Comp Ex 2 | Comp Ex 3 | Comp Ex 4 | Comp Ex 5 |
|---|---|---|---|---|---|---|---|
| Base oil mixture | SAE viscosity grade | | 0W-20 | 0W-20 | 0W-20 | 5W-30 | 5W-30 |
| | Base oil 1 | mass % | 74.41 | 73.51 | 77.76 | 71.79 | 73.79 |
| | Base oil 2 | mass % | | | | 12.00 | |
| | Base oil 3 | mass % | 6.00 | 6.00 | 7.00 | | |
| | Base oil 4 | mass % | | | | | |
| | Base oil 5 | mass % | | | | | 10.00 |
| | Base oil 6 | mass % | | | | | |
| | Base oil 7 | mass % | | | | | |
| | Sulphur content in base mixture (Note 1) | mass % | 0.00 | 0.00 | 0.00 | 0.00 | 0.07 |
| | % CA in base oil mixture (ASTM D3238) (Note 2) | | 0.0 | 0.0 | 0.0 | 0.0 | 0.4 |
| | % CN in base oil mixture (ASTM D3238) (Note 3) | | 23.0 | 23.0 | 23.1 | 22.1 | 23.4 |
| | % CP in base oil mixture (ASTM D3238) (Note 4) | | 77.0 | 77.0 | 76.9 | 77.9 | 76.2 |
| Additives | Glycerine monooleate | mass % | | 0.90 | 0.90 | 0.90 | 0.90 |
| | GF-5 package | mass % | 9.05 | 9.05 | 9.05 | 9.05 | 9.05 |
| | Viscosity index improver-1 | mass % | | | 5.25 | 6.22 | 6.22 |
| | Viscosity index improver-2 | mass % | 10.50 | 10.50 | | | |
| | Antifoaming agent solution | mass % | 0.04 | 0.04 | 0.04 | 0.04 | 0.04 |
| | Total | mass % | 100.00 | 100.00 | 100.00 | 100.00 | 100.00 |
| Properties, performance | Kinematic viscosity @ 100° C. | $mm^2$/sec | 8.7 | 8.7 | 9.0 | 10.3 | 10.4 |
| | Low-temperature viscosity (ASTM D5293) −30° C. | mPas | — | — | — | <6600 | <6600 |
| | Low-temperature viscosity (ASTM D5293) −35° C. | mPas | <6200 | <6200 | <6200 | — | — |
| | Emulsification tests 0° C., 24 hrs | Water separation/ no separation | No sepn | No sepn | No sepn | No sepn | No sepn |
| | Emulsification tests 25° C., 24 hrs | Water separation/ no separation | No Sepn | No Separation | Separation | Separation | Separation |
| | Shell 4-ball wear 40 kgf, 1800 rpm, 50° C., 30 mins | Wear scar diameter, mm | 0.39 | 0.35 | 0.38 | 0.37 | 0.35 |
| | Friction coefficient 80° C., 300 N | | 0.112 | 0.096 | 0.095 | 0.096 | 0.096 |

| | | | Comp Ex 6 | Ex. 1 | Ex. 2 | Ex. 3 | Ex. 4 |
|---|---|---|---|---|---|---|---|
| Base oil mixture | SAE viscosity grade | | 5W-30 | 0W-20 | 5W-30 | 5W-30 | 5W-30 |
| | Base oil 1 | mass % | 64.01 | 52.01 | 54.01 | 44.01 | |
| | Base oil 2 | mass % | | | | | |
| | Base oil 3 | mass % | | | | | |
| | Base oil 4 | mass % | 10.00 | 28.00 | 20.00 | 40.00 | 20.22 |
| | Base oil 5 | mass % | 10.00 | | 10.00 | | |
| | Base oil 6 | mass % | | | | | 5.00 |
| | Base oil 7 | mass % | | | | | 58.79 |
| | Sulphur content in base mixture (Note 1) | mass % | 0.13 | 0.17 | 0.19 | 0.23 | 0.16 |
| | % CA in base oil mixture (ASTM D3238) (Note 2) | | 0.8 | 1.2 | 1.2 | 1.6 | 1.0 |
| | % CN in base oil mixture (ASTM D3238) (Note 3) | | 24.3 | 25.1 | 25.2 | 26.1 | 13.9 |
| | % CP in base oil mixture (ASTM D3238) (Note 4) | | 74.9 | 73.7 | 73.6 | 72.3 | 85.1 |

TABLE 2-continued

| | | | | | | | |
|---|---|---|---|---|---|---|---|
| Additives | Glycerine monooleate | mass % | 0.90 | 0.90 | 0.90 | 0.90 | 0.90 |
| | GF-5 package | mass % | 9.05 | 9.05 | 9.05 | 9.05 | 9.05 |
| | Viscosity index improver-1 | mass % | 6.00 | | 6.00 | 6.00 | 6.00 |
| | Viscosity index improver-2 | mass % | | 10.00 | | | |
| | Antifoaming agent solution | mass % | 0.04 | 0.04 | 0.04 | 0.04 | 0.04 |
| | Total | mass % | 100.00 | 100.00 | 100.00 | 100.00 | 100.00 |
| Properties, performance | Kinematic viscosity @ 100° C. | $mm^2/sec$ | 10.5 | 8.4 | 10.6 | 10.5 | 10.8 |
| | Low-temperature viscosity (ASTM D5293) −30° C. | mPas | <6600 | — | <6600 | <6600 | <6600 |
| | −35° C. | mPas | — | <6200 | — | — | — |
| | Emulsification tests 0° C., 24 hrs | Water separation/ no separation | No sepn | No sepn | No sepn | No sepn | No sepn |
| | 25° C., 24 hrs | | Separation | No sepn | No sepn | No sepn | No sepn |
| | Shell 4-ball wear 40 kgf, 1800 rpm, 50° C. 30 mins | Wear scar diameter, mm | 0.36 | 0.38 | 0.36 | 0.39 | 0.38 |
| | Friction coefficient 80° C., 300 N | | 0.098 | 0.096 | 0.097 | 0.098 | 0.098 |

(Note 1) Denoting sulphur content present as percentage containing taking the base oil overall used in the example or comparative example as 100.
(Note 2) % CA in accordance with ASTM D3238 for the base oil overall used in the example or comparative example.
(Note 3) % CN in accordance with ASTM D3238 for the base oil overall used in the example or comparative example.
(Note 4) % CP in accordance with ASTM D3238 for the base oil overall used in the example or comparative example.

That which is claimed is:

1. A lubricating oil composition for internal combustion engines comprising:

(A) a base oil mixture comprising at least two base oils in different API (American Petroleum Institute) categories, the base oil mixture having a sulphur content of from 0.14 to 0.7 mass %, % CA in accordance with ASTM D3238 of from 0.9 to 5.0, and % CP in accordance with ASTM D3238 of 60 or more, and (B) a monoglyceride with a hydrocarbon group having from 8 to 22 carbon atoms (a glycerine fatty acid ester with the fatty acid ester bonded to one of the three hydroxyl groups of the glycerine), wherein the monoglyceride has a hydroxyl value of from 150 to 300 mgKOH/g and is present at a level of from 0.3 to 2.0 mass % based on the total mass of the composition, wherein the base oil mixture (A) comprises a base oil classified as Group 1 by the API (American Petroleum Institute) with a kinematic viscosity at 100° C. in the range of from 3 to 12 $mm^2/s$, a viscosity index in the range of from 90 to 120, a sulphur content of from 0.03 to 0.7 mass %, % CA of 5 or less according to ASTM D3238, and % CP of 60 or more according to ASTM D3238, and present at a level of from 25 to 50 mass % based on the total mass of the composition;

wherein the lubricating oil composition comprises a friction coefficient in the range of 0.095 to 0.098 at a temperature of 80° C. and a load of 300 newton (N); and wherein the lubricating oil composition is subjected to an emulsification test to determine emulsion stability.

2. The lubricating oil composition for internal combustion engines according to claim 1, wherein the monoglyceride (B) is glycerine monooleate.

3. The lubricating oil composition for internal combustion engines according to claim 1, wherein the composition has a kinematic viscosity at 100° C. in the range of from 5.6 to 15 $mm^2/s$.

4. The lubricating oil composition for internal combustion engines according to claim 1 wherein the monoglyceride is present at a level of from 0.4 to 1.7 mass % based on the total mass of the composition.

5. The lubricating oil composition for internal combustion engines according to claim 1 wherein the monoglyceride is present at a level of from 0.5 to 1.5 mass % based on the total mass of the composition.

6. The lubricating oil composition for internal combustion engines according to claim 1 wherein the ratio of the monoglyceride mass % in the lubricating oil composition to the % CA in the base oil mixture is in the range of from 0.1 to 1.0.

7. The lubricating oil composition for internal combustion engines according to claim 1 wherein the ratio of the monoglyceride mass % in the lubricating oil composition to the % CA in the base oil mixture is in the range of from 0.3 to 1.0.

8. The lubricating oil composition for internal combustion engines according to claim 1 wherein the ratio of the monoglyceride mass % in the lubricating oil composition to the sulphur mass % in the base oil mixture is in the range of from 1.0 to 6.5.

9. The lubricating oil composition for internal combustion engines according to claim 1 wherein the ratio of the monoglyceride mass % in the lubricating oil composition to the sulphur mass % in the base oil mixture is in the range of from 3.5 to 6.0.

10. A method comprising lubricating an internal combustion engine with a lubricating oil composition that comprises:

(A) a base oil mixture comprising at least two base oils in different API (American Petroleum Institute) categories, the base oil mixture having a sulphur content of from 0.14 to 0.7 mass %, % CA in accordance with ASTM D3238 of from 0.9 to 5.0, and % CP in accordance with ASTM D3238 of 60 or more, and (B) a monoglyceride with a hydrocarbon group having from 8 to 22 carbon atoms (a glycerine fatty acid ester with the fatty acid ester bonded to one of the three hydroxyl groups of the glycerine), wherein the monoglyceride has a hydroxyl value of from 150 to 300 mgKOH/g and is present at a level of from 0.3 to 2.0 mass % based on the total mass of the composition, and wherein the internal combustion engine uses a fuel with H/C ratios of from 1.93 to 4, is fitted with idlestop equipment, or uses a fuel incorporating a biofuel or a biodiesel, wherein the base oil mixture (A) comprises a base oil classified as Group 1 by the API (American Petroleum Institute) with a kinematic viscosity at 100° C. in the range of from 3 to 12 $mm^2/s$, a viscosity index in the range of from 90 to 120, a sulphur content of from 0.03 to 0.7 mass %, % CA of 5 or less according to ASTM D3238, and % CP of 60 or more according to ASTM D3238, and present at a level of from 25 to 50 mass % based on the total mass of the composition;

wherein the lubricating oil composition comprises a friction coefficient in the range of 0.095 to 0.098 at a temperature of 80° C. and a load of 300 newton (N); and wherein the lubricating oil composition is subjected to an emulsification test to determine emulsion stability.

11. The method according to claim 10 wherein the monoglyceride (B) is glycerine monooleate.

12. The method according to claim 10 wherein the composition has a kinematic viscosity at 100° C. in the range from 5.6 to 15 $mm^2/s$.

13. The method according to claim 10 wherein the monoglyceride is present at a level of from 0.4 to 1.7 mass % based on the total mass of the composition.

14. The method according to claim 10 wherein the monoglyceride is present at a level of from 0.5 to 1.5 mass % based on the total mass of the composition.

15. The method according to claim 10 wherein the ratio of the monoglyceride mass % in the lubricating oil composition to the % CA in the base oil mixture is in the range of from 0.1 to 1.0.

16. The method according to claim 10 wherein the ratio of the monoglyceride mass % in the lubricating oil composition to the % CA in the base oil mixture is in the range of from 0.3 to 1.0.

17. The method according to claim 10 wherein the ratio of the monoglyceride mass % in the lubricating oil composition to the sulphur mass % in the base oil mixture is in the range of from 1.0 to 6.5.

18. The method according to claim 10 wherein the ratio of the monoglyceride mass % in the lubricating oil composition to the sulphur mass % in the base oil mixture is in the range of from 3.5 to 6.0.

* * * * *